United States Patent [19]

Lazarchik

[11] Patent Number: 4,739,553

[45] Date of Patent: Apr. 26, 1988

[54] RAZOR HANDLE ASSEMBLY

[75] Inventor: Daniel B. Lazarchik, Boston, Mass.

[73] Assignee: The Gillette Company, Boston, Mass.

[21] Appl. No.: 941,796

[22] Filed: Dec. 15, 1986

[51] Int. Cl.[4] ..... B26B 21/00

[52] U.S. Cl. ..... 30/47; 30/89

[58] Field of Search ..... 30/47, 57, 66, 75, 87–89, 30/330–333

[56] References Cited

U.S. PATENT DOCUMENTS

| | | | |
|---|---|---|---|
| 3,088,252 | 5/1963 | Schmidt | 30/330 X |
| 3,768,162 | 10/1973 | Perry | 30/47 |
| 3,935,639 | 2/1976 | Terry et al. | 30/47 |
| 3,938,247 | 2/1976 | Carbonell et al. | 30/47 |
| 4,026,016 | 5/1977 | Nissen | 30/47 |
| 4,083,104 | 4/1978 | Nissen | 30/47 |
| 4,266,340 | 5/1981 | Bowman | 30/89 |
| 4,488,357 | 12/1984 | Jacobson | 30/57 |
| 4,492,025 | 1/1985 | Jacobson | 30/87 |

*Primary Examiner*—Douglas D. Watts
*Attorney, Agent, or Firm*—Scott R. Foster

[57] ABSTRACT

A razor handle assembly comprising a grip portion, a head portion at one end of the grip portion having first and second arms pivotally movable toward and away from each other and having, respectively, first and second shell bearings mounted thereon, the shell bearings being adapted to receive a shaving cartridge for pivotal movement on the handle, and a spring-biased button member movable in the head portion, the button member having outwardly extending detents, the arms having opposed cam surfaces, the detents being engageable with the cam surfaces, and spring means urging the arm cam surfaces into engagement with the button member detents, to position the arms in a selected posture.

4 Claims, 3 Drawing Sheets

RAZOR HANDLE ASSEMBLY

BACKGROUND OF THE INVENTION

1. Field of the Invention

This invention relates to wet shaving implements and is directed more particularly to a razor handle assembly on which a shaving cartridge is pivotally movable during a shaving operation.

2. Description of the Prior Art

It is known in the art to provide a razor handle assembly which may be connected to, and used in conjunction with, a shaving cartridge to facilitate shaving operations. U.S. Pat. No. 3,768,162, issued Oct. 30, 1973, in the name of Roger L. Perry shows a razor handle assembly adapted to receive and retain a shaving cartridge.

It is further known that shaving efficiency may be improved if the shaving cartridge is adapted to pivot on the razor handle during a shaving operation, permitting the cartridge to more closely follow the contours of a surface being shaved. U.S. Pat. Nos. 3,935,639, issued Feb. 3, 1976, in the name of John C. Terry, et al, and 3,938,247, issued Feb. 17, 1976, in the name of Nelson C. Carbonell, et al, are illustrative of razor handles adapted to accept shaving cartridges in such manner as to permit pivotal movement of the cartridge during a shaving operation. U.S. Pat. Nos. 4,026,016, issued May 31, 1977, in the name of Warren I. Nissen, and 4,083,104, issued Apr. 11, 1978, in the name of Warren I. Nissen, illustrate, respectively, a shaving cartridge and razor handle comprising a shaving system in which the cartridge pivots on the handle during shaving. The shaving system shown in the '016 and '104 patents has become well known world-wide. However, it is sometimes difficult to discern whether the shaving cartridge is squarely on the small pivot mounting journals of the handle. As a consequence, shaving operations are sometimes begun with the cartridge attached to only one journal, or neither journal.

In U.S. Pat. No. 4,492,025, issued Jan. 8, 1985 to Chester F. Jacobson, there is disclosed a razor handle having shell bearing means thereon for positive attachment to a shaving cartridge to facilitate pivotal movement of the cartridge thereon during a shaving operation. The shell bearings provide a more secure pivot mounting means and one which is more easily discerned by the eye of an operator.

In the '025 handle assembly, the shell bearings, respectively mounted on two arms, are moved toward each other, against a spring bias, by squeezing the two arms together, thereby releasing a cartridge from the shell bearings. It has been deemed desirable to provide a "one-button" embodiment which would enable an operator to activate both shell bearing supporting arms by a single push of a button.

SUMMARY OF THE INVENTION

An object of the present invention is to provide a razor handle assembly which provides the benefits of the U.S. Pat. No. 4,492,025-type handle, but having facility for a single button operation.

With the above and other objects in view, as will hereinafter appear, a feature of the present invention is the provision of a safety razor handle assembly comprising a grip portion, a head portion at one end of the grip portion, the head portion having first and second arms pivotally moveable toward and away from each other and having, respectively, first and second shell bearings mounted thereon, the shell bearings being adapted to receive a shaving cartridge for pivotal movement on the handle, and a spring-biased button member movable in the head portion, the button member having outwardly extending detents, the arms having opposed cam surfaces, the detents being engageable with the cam surfaces, and spring means urging the arm cam surfaces into engagement with the button member detents, to move the arms to a selected position.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
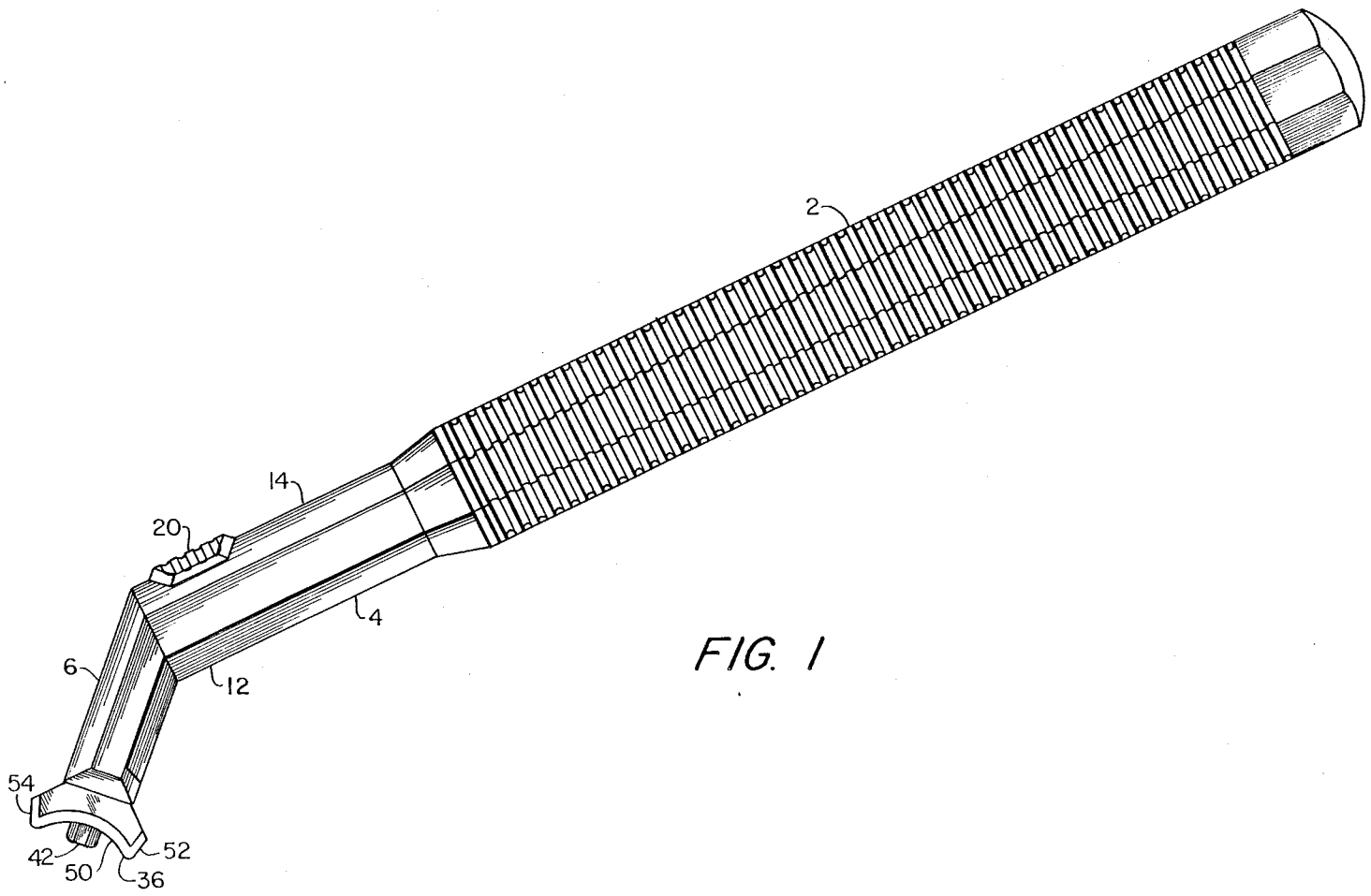
FIG. 1 is a side elevational view of one form of razor handle assembly illustrative of an embodiment of the invention.
Figure 2:
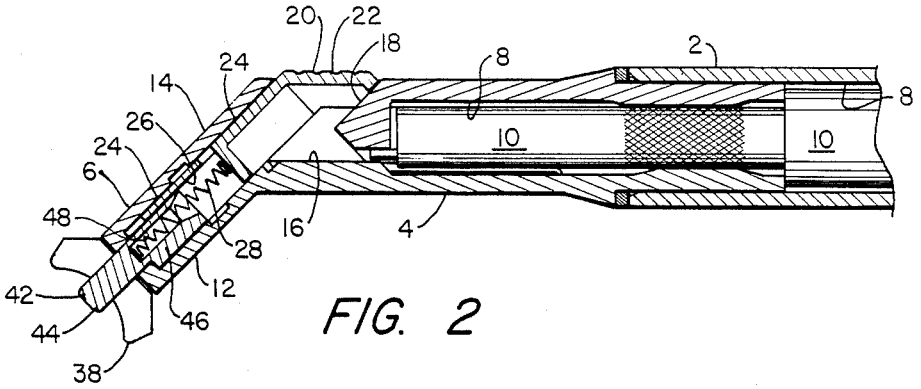
FIG. 2 is a partial view of the handle assembly, showing parts broken away and parts in section.
Figure 3:
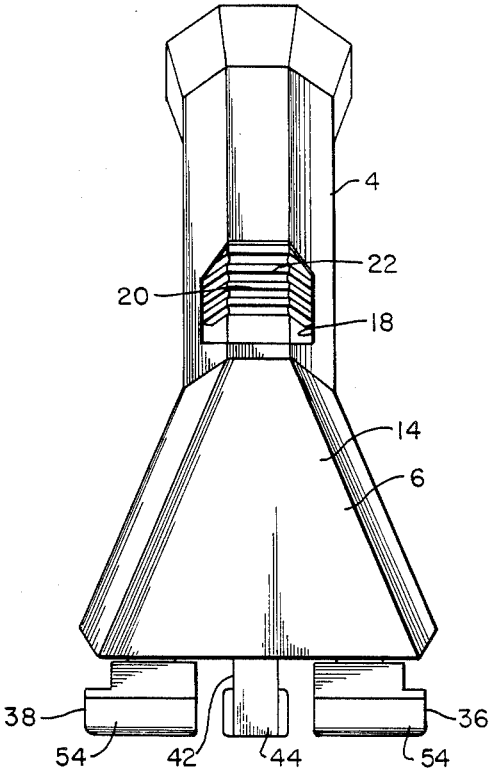
FIG. 3 is a back elevational view of the portion of the assembly illustrated in FIG. 2.

Referring to the drawings, it will be seen that an illustrative razor handle assembly includes handle grip portion 2, a neck portion 4, and a head portion 6. The handle may be constructed of plastic and, if additional weight is deemed desirable, the handle may be provided with a cavity 8 (FIG. 2) adapted to receive a weight 10 of metal.

The head and neck portions 6, 4 preferably include a front plate 12 and a back plate 14 defining therebetween a compartment 16. The back plate 14 has an opening 18 therein. A button member 20 is disposed in the opening 18 and extends into the compartment 16. The button member includes a pusher surface 22 disposed on the outside of the handle for manual engagement by an operator, and a trunk portion 24 slidably disposed in the compartment 16. The trunk portion includes a chamber 26 in which is disposed a first end of a coil spring 28. The end of the trunk portion removed from the button member 20 is provided with outwardly extending detents 30.

Figure 4:
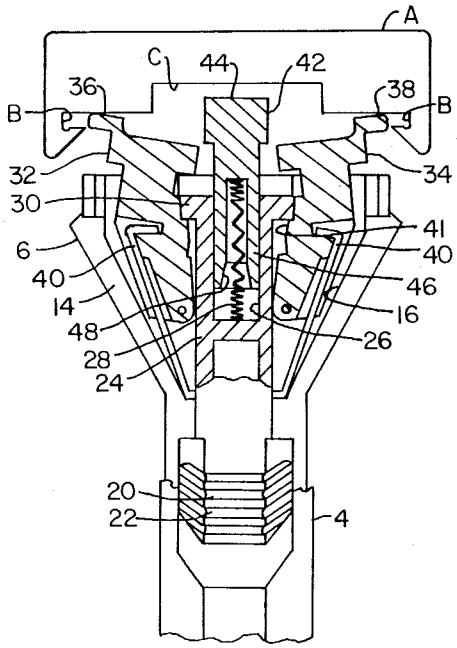
FIG. 4 is a back elevational view of the head portion, with a cover plate removed.
Figure 5:
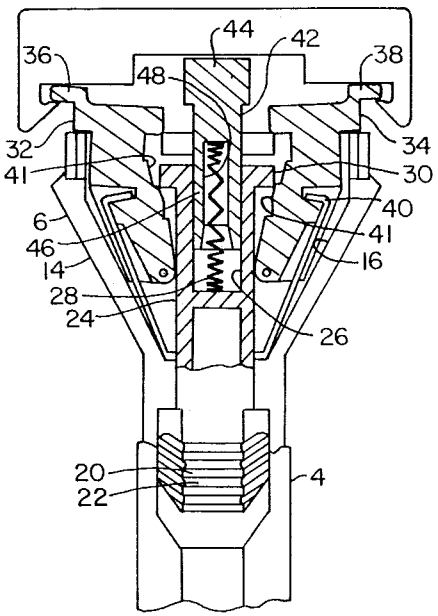
FIGS. 5 and 6 are similar to FIG. 4, but show the handle assembly mechanism during a cycle of operation, in conjunction with a diagrammatically illustrated shaving cartridge.

Pivotally mounted in the compartment 16 are opposed first and second arms 32, 34 having first and second shell bearings 36, 38 respectively mounted on the free ends thereof. Also mounted in the compartment 16 is a leaf spring 40 which urges the arms 32, 34 pivotally toward each other and in abutting engagement with the trunk portion 24 of the button member 20, and more particularly with the detents 30 thereof. The inboard edges of the arms 32, 34 are provided with cam surfaces 41, as shown in FIGS. 4–6, which engage the detents 30.

Slidingly disposed in the chamber 26 of the trunk portion 24 of the button member 20 is a plunger 42 having a head portion 44, and a spindle portion 46, the spindle portion having a recess 48 therein, in which is mounted a second end of the coil spring 28. Thus, the plunger 42 is spring biased upwardly, as viewed in FIGS. 4–6, and leftwardly as viewed in FIG. 2.

The shell bearings 36, 38 are each provided with a curved bearing member 50 having at either end thereof a stop portion 52, 54. A shaving cartridge A, shown diagrammatically in FIGS. 4–6, is provided with mounting means B complementary to and slidable on the shell bearing surfaces 50, and with a centrally disposed cam surface C, adapted to receive the head portion 44 of the plunger 42. The plunger 42 exercises a bias on the shaving cartridge to urge the cartridge to a given position on the shell bearings. The stop portions 52, 54 limit the degree of pivotal movement of the cartridge on the razor by engagement with portions of the cartridge.

Figure 6:
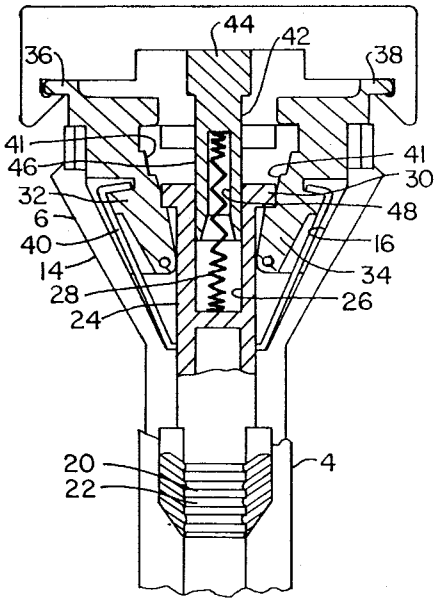

The razor handle assembly is shown in FIG. 6 connected to a shaving cartridge. If it is desired to change cartridges, an operator manually moves the button member 20 upwardly as viewed in FIGS. 4–6, and leftwardly as viewed in FIG. 2, by hand engagement with the button pusher surface 22. Movement of the button causes similar movement of the trunk portion 24, causing the detents 30 to move toward the shell bearings. As the detents 30 move, the arms 32, 34 pivot inwardly under the influence of the leaf spring 40. As the trunk portion 24 moves upwardly, the plunger spindle portion 46 moves further into the chamber 26, against the bias of the coil spring 28 (FIG. 5).

Continued movement of the button (FIG. 4) permits the arms 32, 34 to move still closer together to dislodge the shell bearings 36, 38 from the shaving cartridge A to permit the shaving cartridge to fall free of the handle. The leaf spring 40 exercises sufficient force on the arms 32, 34 to retain the arms in the position shown in FIG. 4, upon release of the button 20 by the operator.

When it is desired to attach a new cartridge to the razor handle assembly, the head portion 6 of the razor handle is pushed against the underside of the new shaving cartridge, such that the first and second shell bearings 36, 38 are engaged by the cartridge which pushes the bearings 36, 38 against the bias of the leaf spring 40, outwardly in opposite directions. The outward movement of the bearings overcomes the bias of the leaf spring 40, facilitating movement of the shell bearings 36, 38 into engagement with the new cartridge (FIG. 5). The outward movement of the bearings 36, 38 and thereby the arms 32, 34, removes the arm cam surfaces 41 from engagement with the detents 30, permitting the button member 20 to move downwardly, as viewed in FIGS. 4–6, under the influence of the coil spring 28, to return the button member to its initial, or "at rest" position. With the button member 20 in its downward position (FIG. 6), the detents 30 engage the arm cam surfaces 41 to retain the arms 32, 34 in their outward, cartridge retaining, position. Thus, by activation of a single button, as by a single finger of an operator, a cartridge change may be effected.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A razor handle assembly comprising a grip portion, a neck portion at one end of said grip portion, and a head portion at one end of said neck portion, first and second arms pivotally mounted in said head portion for movement toward and away from each other, first spring means mounted in said portion and bearing against said arms to urge said arms toward each other, a first shell bearing mounted on said first arm and a second shell bearing mounted on said second arm, said shell bearings being adapted to receive a shaving cartridge and to permit pivotal movement of said shaving cartridge on said handle, a manually operable button having a trunk portion extending into said razor head portion, detents extending outwardly from said trunk portion toward said arms and adapted to engage said arms, said arms being urged into engagement with said trunk portion detents by said first spring means, said arms having opposed cam surfaces engageable with said detents, a plunger reciprocally disposed in said trunk portion and biased by a second spring in a direction toward said arms, a head portion of said plunger being adapted to engage an underside of said shaving cartridge, whereby manual operation of said button causes movement of said detents upon said cam surfaces to facilitate pivotal movement of said arms responsive to the positioning of said detents and the force of said first spring to cause movement of said shell bearings to engage or disengage said bearings relative to said shaving cartridge, one of said shell bearings being provided with stop means for limiting the movement of said shaving cartridge on said shell bearings, said stop means comprising tab means extending from and transversely of a surface of the shell bearing.

2. The razor handle assembly in accordance with claim 1 in which said first spring means comprises a substantially U-shaped leaf spring bearing against said arms to urge said arms toward each other to release said shaving cartridge.

3. The razor handle assembly in accordance with claim 1 in which said leaf spring has first and second upstanding legs disposed outwardly of said first and second arms, resectively, and operating to urge said arms toward each other to release said shaving cartridge.

4. The razor handle assembly in accordance with claim 3 in which said detents may be positioned against said cam surfaces to maintain said arms removed from each other, against the bias of said leaf spring, to engage said shaving cartridge.

* * * * *